US009976236B2

(12) United States Patent
Terai et al.

(10) Patent No.: US 9,976,236 B2
(45) Date of Patent: May 22, 2018

(54) METHOD FOR PRODUCING SHOE UPPER, AND SHOE UPPER

(71) Applicant: SHIMA SEIKI MFG., LTD., Wakayama-shi, Wakayama (JP)

(72) Inventors: Kenta Terai, Wakayama (JP); Takashi Kino, Wakayama (JP); Masamitsu Ikenaka, Wakayama (JP)

(73) Assignee: SHIMA SEIKI MFG., LTD., Wakayama-shi, Wakayama (JP)

( * ) Notice: Subject to any disclaimer, the term of this patent is extended or adjusted under 35 U.S.C. 154(b) by 301 days.

(21) Appl. No.: 14/782,835

(22) PCT Filed: Mar. 28, 2014

(86) PCT No.: PCT/JP2014/059171
§ 371 (c)(1),
(2) Date: Oct. 7, 2015

(87) PCT Pub. No.: WO2014/171300
PCT Pub. Date: Oct. 23, 2014

(65) Prior Publication Data

US 2016/0066651 A1 Mar. 10, 2016

(30) Foreign Application Priority Data

Apr. 15, 2013 (JP) ..... 2013-85144

(51) Int. Cl.
*D04B 1/24* (2006.01)
*A43B 1/04* (2006.01)
(Continued)

(52) U.S. Cl.
CPC ..... *D04B 1/24* (2013.01); *A43B 1/04* (2013.01); *A43B 23/0205* (2013.01);
(Continued)

(58) Field of Classification Search
CPC ..... D04B 1/108; D04B 1/123; D04B 1/22; D04B 1/24; A43B 23/0245
See application file for complete search history.

(56) References Cited

U.S. PATENT DOCUMENTS 5,170,646 A * 12/1992 Gariboldi ..... D04B 1/108 66/172 R
5,299,435 A * 4/1994 Whalley ..... D04B 1/123 66/190
(Continued)

FOREIGN PATENT DOCUMENTS

DE 297 00 546 U1 5/1997
EP 2 149 629 A1 2/2010
(Continued)

OTHER PUBLICATIONS

Extended European Search Report issued by the European Patent Office dated Oct. 26, 2016, for counterpart European application No. 14785920.1, 7 pages.
(Continued)

*Primary Examiner* — Danny Worrell
(74) *Attorney, Agent, or Firm* — Rothwell, Figg, Ernst & Manbeck, P.C.

(57) ABSTRACT

There is provided a method for producing a shoe upper with which a shoe upper can be produced with high productivity, and a shoe upper obtained with the method for producing the shoe upper. An instep cover section (3) and a sole cover section (2) are integrally knitted in a seamless manner by carrying out process α and then carrying out process β or by carrying out process β and then carrying out process α with a flat knitting machine including at least a pair of a front and a back needle bed. [Process α] Knitting a main body left portion (3L), which is a left side portion of the instep cover section (3), with one needle bed of the flat knitting machine and knitting a main body right portion (3R), which is a right
(Continued)

side portion of the instep cover section (3), with the other needle bed of the flat knitting machine. [Process β] Knitting a bottom left portion (2L), which is a left side portion of the sole cover section (2) with one needle bed, and a bottom right portion (2R), which is a right side portion of the sole cover section (2), with the other needle bed.

7 Claims, 3 Drawing Sheets

(51) Int. Cl.

| | |
|---|---|
| ***A43B 23/04*** | (2006.01) |
| ***D04B 1/22*** | (2006.01) |
| ***A43B 23/02*** | (2006.01) |
| ***D04B 1/10*** | (2006.01) |

(52) U.S. Cl.
CPC ..... *A43B 23/04* (2013.01); *A43B 23/042* (2013.01); *D04B 1/106* (2013.01); *D04B 1/22* (2013.01); *D10B 2403/0332* (2013.01); *D10B 2501/043* (2013.01)

(56) References Cited

U.S. PATENT DOCUMENTS

| | | | | |
|---|---|---|---|---|
| 7,263,860 | B2 * | 9/2007 | Okuno | D04B 1/18 66/64 |
| 8,434,331 | B2 * | 5/2013 | Funaki | D04B 1/108 66/174 |
| 9,441,315 | B2 * | 9/2016 | Ikenaka | D04B 1/123 |
| 9,551,096 | B2 * | 1/2017 | Nishino | D04B 1/26 |
| 9,611,571 | B2 * | 4/2017 | Ikenaka | D04B 1/22 |
| 9,719,198 | B2 * | 8/2017 | Ikenaka | D04B 1/22 |
| 9,771,673 | B2 * | 9/2017 | Ikenaka | D04B 1/22 |
| 2008/0110049 | A1 | 5/2008 | Sokolowski et al. | |
| 2012/0234052 | A1 | 9/2012 | Huffa et al. | |
| 2012/0285043 | A1 * | 11/2012 | Dua | A43B 1/04 36/84 |
| 2014/0150295 | A1 * | 6/2014 | Dua | A43B 1/04 36/84 |
| 2014/0245643 | A1 * | 9/2014 | Huffa | A43B 1/04 36/9 R |
| 2015/0107307 | A1 | 4/2015 | Kosui et al. | |
| 2015/0173458 | A1 | 6/2015 | Ikenaka | |

FOREIGN PATENT DOCUMENTS

| | | | |
|---|---|---|---|
| JP | 2012-512698 | A | 6/2012 |
| WO | 2010/080182 | A1 | 7/2010 |
| WO | 2013/108506 | A1 | 7/2013 |
| WO | 2014/013790 | A1 | 1/2014 |

OTHER PUBLICATIONS

International Search Report cited in PCT/JP2014/059171 dated Jun. 23, 2014, 1 page.

* cited by examiner

METHOD FOR PRODUCING SHOE UPPER, AND SHOE UPPER

CROSS REFERENCE TO RELATED APPLICATION

This application is a 35 U.S.C. 371 National Phase Entry Application from PCT/JP2014/059171, filed Mar. 28, 2014, which claims the benefit of Japan Patent Application No. 2013-085144 filed on Apr. 15, 2013, the disclosure of which is incorporated herein in its entirety by reference.

TECHNICAL FIELD

The present invention relates to a method for producing a shoe upper, and a shoe upper obtained by using the method for producing the shoe upper.

BACKGROUND ART

The shoe includes a shoe upper with a sole cover section that covers a sole of a wearer, and an instep cover section that covers a portion on an instep side of the wearer. In outdoor shoes, an outer sole made of synthetic resin and the like is attached to the sole cover section of the shoe upper. In recent years, attempts have been made to form an instep cover section, of the instep cover section and the sole cover section configuring the shoe upper, with one knitted fabric to produce the shoe with high productivity. For example, in Patent Document 1, the instep cover section in the planarly developed state is produced with one knitted fabric, and joined to the outer sole made with synthetic resin and the like along with the sole cover section to complete the shoe.

PRIOR ART DOCUMENT

Patent Document

[Patent Document 1] Japanese Patent Publication No. 2012-512698

DISCLOSURE OF THE INVENTION

Problems to be Solved by the Invention

However, the shoe of the Patent Document 1 still can be improved in terms of productivity.

In Patent Document 1, one knitted fabric is cut to obtain the instep cover section or fashioning is carried out to obtain the instep cover section. In the former case, cutting process for cutting the knitted fabric, and sewing process for forming the instep cover section to a three-dimensional shape are required. In the latter case, the cutting process is not necessary, but the sewing process is necessary.

The present invention has been made in light of the foregoing, and an object of the present invention is to provide a method for producing a shoe upper with which a shoe upper can be produced with high productivity, and a shoe upper obtained with the method for producing the shoe upper.

Means for Solving the Problems

An aspect of the present invention relates to a method for producing a shoe upper for producing the shoe upper including an instep cover section that includes an opening and covers a portion on an instep side of a wearer and a sole cover section that covers a sole of the wearer. In the method for producing the shoe upper according to the present invention, the instep cover section and the sole cover section are integrally knitted in a seamless manner with a flat knitting machine including at least a pair of a front and a back needle bed by carrying out either [1] or [2] below.

[1] Process α that includes knitting a set up portion of the instep cover section is carried out and then process β is carried out, and the sole cover section knitted in a state separated to right and left in the process β is connected.

[2] Process β that includes knitting the set up portion of the sole cover section is carried out and then the process α is carried out, and unraveling prevention of a knitting terminating portion of the instep cover section is carried out.

[Process α] Knitting a main body left portion with one needle bed of the flat knitting machine and knitting a main body right portion with the other needle bed of the flat knitting machine using at least one of flechage knitting or tubular knitting so that the main body left portion to become a left side portion of the instep cover section and the main body right portion to become a right side portion of the instep cover section are connected on a heel side and a toe side of the shoe upper 1.

[Process β] Knitting a bottom left portion with one needle bed of the flat knitting machine and knitting a bottom right portion with the other needle bed of the flat knitting machine using flechage knitting so that the bottom left portion to become a left side portion of the sole cover section and the bottom right portion to become a right side portion of the sole cover section are separated.

According to one aspect of the method for producing the shoe upper of the invention, when knitting an overlapping knitted fabric section in which the set up portion or the knitting terminating portion is connected to the main body left portion and the main body right portion of the instep cover section and overlapped in a thickness direction of the instep cover section, the knitting is carried out in the following manner.

- Knitting of increasing a stitch row configuring the instep cover section is not carried out until the knitting of the overlapping knitted fabric section is terminated.
- When increasing the stitch row configuring the instep cover section, a state in which stitches of the overlapping knitted fabric section are not held on the needle beds for knitting the instep cover section is obtained.

The phrase "state in which stitches of the overlapping knitted fabric section are not held on the needle beds for knitting the instep cover section" is a state in which the stitches of the overlapping knitted fabric section are not formed at all (see variation 1-2), state in which the stitches of the overlapping knitted fabric section are removed from the needle beds (see variation 1-1), or state in which the stitches of the overlapping knitted fabric section are transferred from the needle beds for knitting the instep cover section (see first embodiment).

Briefly, the method for producing the shoe upper for knitting the overlapping knitted fabric section is a method for producing a shoe upper for sequentially knitting the instep cover section and the overlapping knitted fabric section, rather than knitting the instep cover section and the overlapping knitted fabric section in parallel. For example, a procedure of setting up the overlapping knitted fabric section before knitting the instep cover section, and starting the knitting of the instep cover section after completing the overlapping knitted fabric section, as in the first embodiment, may be adopted. Alternatively, a procedure of knitting a part of the instep cover section, and thereafter, temporary stopping the knitting of the instep cover section to set up and complete the overlapping knitted fabric section, and then knitting the remaining instep cover section may be adopted, as in the variation 1-2.

According to one aspect of the method for producing the shoe upper of the present invention for knitting the overlapping knitted fabric section, knitting in the following procedure may be carried out in the process α. In this aspect, the process α may be carried out first, or the process β may be carried out first.

The overlapping knitted fabric section is set up at a position overlapping a knitting region of the instep cover section, and the overlapping knitted fabric section is completed using the flechage knitting.

Thereafter, a stitch row of the knitting terminating portion of the overlapping knitted fabric section is overlapped and connected with a stitch row of a part of the instep cover section and knitting is carried out to increase the stitch row configuring the instep cover section.

According to one aspect of the method for producing the shoe upper of the present invention for knitting the overlapping knitted fabric section, knitting in the following procedure may be carried out in the process α. In this aspect, the process α may be carried out first, or the process β may be carried out first.

The set up portion of the overlapping knitted fabric section branched from the instep cover section is knitted at the position overlapping the knitting region of the instep cover section.

The overlapping knitted fabric section is completed following the set up portion, and the overlapping knitted fabric section is removed from the needle beds.

According to one aspect of the method for producing the shoe upper of the present invention for knitting the overlapping knitted fabric section, the overlapping knitted fabric section may be connected to a vicinity of the opening of the instep cover section.

According to one aspect of the method for producing the shoe upper of the invention, when carrying out the process β after the process α, the sole cover section in the process β may be knitted with a fusible knitting yarn including a heat fusible yarn; and after connecting the bottom left portion and the bottom right portion knitted in a state separated in the process β by knitting, a connecting portion may be fused by thermal process.

An aspect of the present invention relates to a shoe upper including an instep cover section that includes an opening and covers a portion on an instep side of a wearer and a sole cover section that covers a sole of the wearer. In the shoe upper of the present invention, when assuming a left side portion and a right side portion of the instep cover section as a main body left portion and a main body right portion, respectively, and a left side portion and a right side portion of the sole cover section as a bottom left portion and a bottom right portion, respectively; at least [1] to [3] below are satisfied.

[1] A seam is not formed between the main body left portion and the bottom left portion and between the main body right portion and the bottom right portion.

[2] A set up portion or a knitting terminating portion of the shoe upper is formed at a boundary portion of the bottom left portion and the bottom right portion.

[3] A knitting width direction of the instep cover section and the sole cover section is a length direction of the shoe upper.

Effects of the Invention

According to the method for producing the shoe upper of the present invention, the shoe upper of the present invention in which the instep cover section and the sole cover section are integrally knitted in a seamless manner can be easily produced without using a complex knitting operation. According to the method for producing the shoe upper of the present invention, the shoe upper of the present invention in which the knitting width directions of the instep cover section and the sole cover section are aligned in the length direction of the shoe upper can be produced. Thus, the shoe upper of the present invention, in which the knitting width directions are aligned as a whole and the step difference or the seam is not provided between the instep cover section and the sole cover section, excels in appearance and comfortableness in wearing.

According to the method for knitting the shoe upper of the present invention for knitting the overlapping knitted fabric section, the instep cover section may partially have a multi-layered structure. For example, portions such as the heel and the opening may have a multi-layered structure so that the instep cover section can be reinforced. Furthermore, the portion having the multi-layered structure can be used as a storing section for storing a cushion material and the like.

In the method for producing the shoe upper of the present invention, a configuration of sequentially knitting the overlapping knitted fabric section and the instep cover section is adopted so that the instep cover section partially has a multi-layered structure. Thus, the instep cover section is not knitted while knitting the overlapping knitted fabric section, whereby the loop quality of the overlapping knitted fabric section is not degraded compared to that of the instep cover section. The portion having the multi-layered structure serves to reinforce the instep cover section and also serves as a storing section for the cushion material and the like. In particular, the opening can be reinforced and the designability around the opening can be enhanced by connecting the overlapping knitted fabric section to the vicinity of the opening of the instep cover section.

MODE FOR CARRYING OUT THE INVENTION

Hereinafter, embodiments of a method for producing a shoe upper of the present invention and a shoe upper of the present invention will be described based on the drawings. A two-bed flat knitting machine including at least a pair of a front and a back needle bed and in which stitches can be transferred between the front and back needle beds is used for the method for producing the shoe upper. In any embodiments, the knitting of holding the stitches on the odd-numbered knitting needles in one needle bed of the flat knitting machine, and holding the stitches on the even-numbered knitting needles in the other needle bed, or a so-called half-gauge knitting is carried out. The flat knitting machine to be used is, of course, not limited to the two-bed flat knitting machine, and may be, for example, a four-bed flat knitting machine.

First Embodiment

<<Overall Configuration>>

Figure 1:
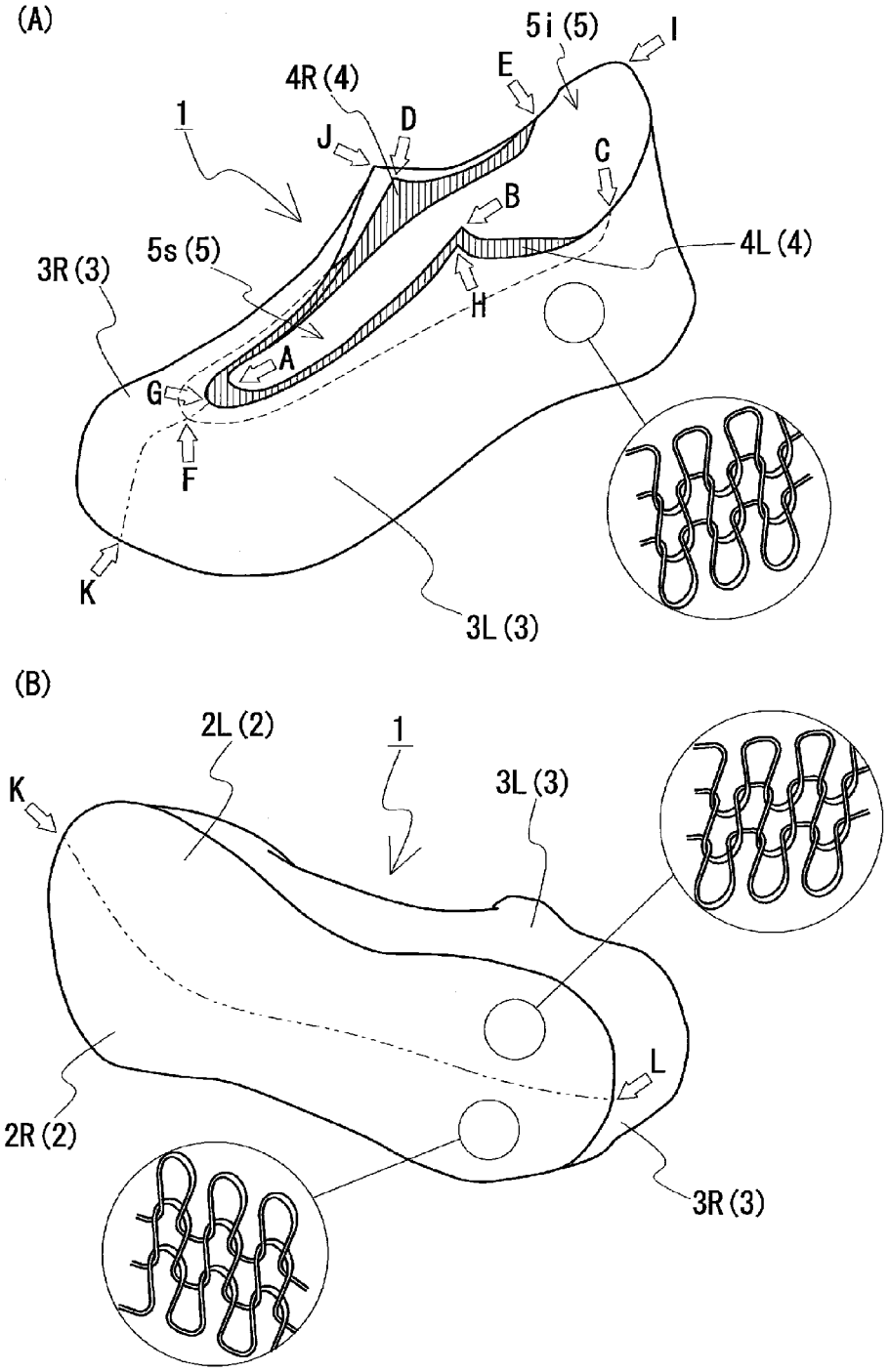
FIG. 1(A) is a schematic top perspective view of a shoe upper shown in a first embodiment.
FIG. 1(B) is a schematic bottom perspective view of the shoe upper.

A shoe upper 1 of the present embodiment shown in FIG. 1 includes an instep cover section 3 that covers a portion on an instep side of the wearer, and a sole cover section 2 that covers a portion of a sole of the wearer. The shoe upper 1 may further include an outer sole (not shown) on an outer side of the sole cover section 2. The shoe upper 1 of the present embodiment differs from the conventional shoe upper in the following two points.

[1] The instep cover section 3 and the sole cover section 2 do not have a seam, and are knitted three-dimensionally in a seamless manner.

[2] The knitting width directions of the instep cover section 3 and the sole cover section 2 are both aligned in a length direction of the shoe upper 1, that is, a direction connecting the heel and the toe (see circled enlarged view).

The configurations of [1] and [2] are formed from the method for producing the shoe upper 1. The details will be described later, but the method for producing the shoe upper 1 can be roughly described as below.

Knit a main body left portion 3L, which is a left side portion of the instep cover section 3, and a bottom left portion 2L, which is a left side portion of the sole cover section 2, with one needle bed arranged in the flat knitting machine.

Knit a main body right portion 3R, which is a right side portion of the instep cover section 3, and a bottom right portion 2R, which is a right side portion of the sole cover section 2, with the other needle bed arranged in the flat knitting machine.

The right and left distribution of the instep cover section 3 and the sole cover section 2 is not particularly limited, but the distribution is preferably about 1:1.

The instep cover section 3 and the sole cover section 2 are preferably knitted with a fusible knitting yarn including a heat fusible yarn. Through the use of the fusible knitting yarn, the shoe upper 1 can be shaped three-dimensionally when the shoe upper 1 is fitted to a last (foot model) and thermally processed. The instep cover section 3 and the sole cover section 2 may, of course, be knitted with a non-fusible knitting yarn that does not include the heat fusible yarn, or a part of the instep cover section 3 and the sole cover section 2 may be knitted with the fusible knitting yarn, and the remaining portion may be knitted with the non-fusible knitting yarn. For example, the toe, the heel, the portion slightly on the heel side of the base of the toe and the like may be knitted with the fusible knitting yarn, and the remaining portion may be knitted with the non-fusible knitting yarn.

An opening 5 is formed on the upper side of the instep cover section 3. The opening 5 includes a foot insertion opening 5*i*, to which the wearer inserts the foot, and a slit 5*s* extending from the foot insertion opening 5*i* toward the toe. An inner side knitted fabric section (overlapping knitted fabric section) 4 is connected to the inner side of the instep cover section 3 in the vicinity of the hem portion of the opening 5 (see hatching portion). The inner side knitted fabric section 4 of the present embodiment is arranged to frame the vicinity of the hem portion of the opening 5 excluding a part of the heel side. The inner side knitted fabric section 4 may, of course, be arranged to frame the entire vicinity of the hem portion of the opening 5. In addition, the inner side knitted fabric section 4 may be arranged at the portion other than the hem portion of the opening 5, for example, the portion of the heel.

The inner side knitted fabric section 4 is not an essential configuration, but the hem portion of the opening 5 can be reinforced by arranging the inner side knitted fabric section 4 near the hem portion of the opening 5. In addition, the designability of the shoe upper 1 can be enhanced by the inner side knitted fabric section 4. The inner side knitted fabric section 4 may be knitted with the fusible knitting yarn or may be knitted with the non-fusible knitting yarn. In the latter case, the inner side knitted fabric section 4 will have a soft finish, so that blisters are less likely caused by the hem portion of the opening 5.

An outer side knitted fabric section (overlapping knitted fabric section) connected in the vicinity of the hem portion of the opening 5 to the outer side of the instep cover section 3 may be arranged in place of the inner side knitted fabric section 4. Similar to the inner side knitted fabric section 4, the outer side knitted fabric section has an effect of reinforcing the hem portion of the opening 5 and an effect of enhancing the designability of the shoe upper 1. As shown in a third embodiment to be described later, both the inner side knitted fabric section 4 and the outer side knitted fabric section 6 (see FIG. 3) may be arranged in the instep cover section 3.

<<Method for Producing Shoe Upper>>

The shoe upper 1 can be produced by a first producing method of starting the knitting from the side of the instep cover section 3 and ending the knitting on the side of the sole cover section 2, or a second producing method of starting the knitting from the side of the sole cover section 2 and ending the knitting on the side of the instep cover section 3. In the present embodiment, the first producing method will be described. In the description, the important areas in the knitting indicated with an outlined arrow and the upper case alphabets in FIG. 1 will be referenced. The procedure of the first producing method shown below is merely an example, and the method for producing the shoe upper of the present invention is not limited to the following procedure.

First, before knitting the instep cover section 3, a set up portion (line A-B-C of FIG. 1(A)) of the inner left portion 4L, which is the left side portion of the inner side knitted fabric section 4, is knitted with one needle bed, and a set up portion (line A-D-E of FIG. 1(A)) of the inner right portion 4R, which is the right side portion of the inner side knitted fabric section 4, is knitted with the other needle bed. The inner side knitted fabric section 4 is completed using the flechage knitting and the C-shaped knitting based on each set up portion. At this time point, the stitches of line F-C of the inner left portion 4L are held on one needle bed, and the stitches of line F-E of the inner right portion 4R are held on the other needle bed.

Next, the stitches of the inner left portion 4L held on one needle bed are transferred to the empty needles of the other needle bed, and a set up portion (line G-H-C-I) of the main body left portion 3L, which is the left side portion of the instep cover section 3, is knitted with one needle bed using a yarn feeder different from the yarn feeder used for the knitting of the inner side knitted fabric section 4. A part (portion surrounded with G-H-C-F) of the main body left portion 3L is knitted using the flechage knitting based on such set up portion, and the stitches of the inner left portion 4L transferred to the other needle bed are overlapped with the stitches of the main body left portion 3L on the one needle bed. As a result, the inner left portion 4L and the main body left portion 3L are connected at line F-C.

In the method for knitting the shoe upper of the present embodiment, the knitting of the instep cover section 3 is started after the inner side knitted fabric section 4 is completed, and thus the yarn feeder same as the yarn feeder used for the knitting of the inner side knitted fabric section 4 can be used to knit the instep cover section 3.

The stitches of the inner right portion 4R held on the other needle bed are then transferred to the empty needles of the one needle bed, and a set up portion (line G-J-E-I) of the main body right portion 3R, which is the right side portion of the instep cover section 3, is knitted with the other needle bed. A part (portion surrounded with G-J-E-F) of the main body right portion 3R is knitted using the flechage knitting based on such set up portion, and the stitches of the inner right portion 4R transferred to the one needle bed are overlapped with the stitches of the main body right portion 3R on the other needle bed. As a result, the inner right portion 4R and the main body right portion 3R are connected at line F-E.

In the main body left portion 3L and the main body right portion 3R, a plurality of eyelet holes lined along the forming direction of the slit 5*s* may be formed. A shoelace type shoe upper 1 can be obtained by forming the eyelet holes. The eyelet holes can be formed through a known mesh knitting and the like.

Then, the main body left portion 3L of the instep cover section 3 is knitted with one needle bed and the main body right portion 3R of the instep cover section 3 is knitted with the other needle bed. In this case, the flechage knitting and the C-shaped knitting are appropriately used to complete the instep cover section 3. For example, in the present embodiment, the C-shaped knitting of connecting the main body left portion 3L and the main body right portion 3R at line F-K on the toe side of the shoe upper 1 and knitting the main body left portion 3L and the main body right portion 3R in a seamless manner on the heel side are mainly carried out, and the flechage knitting is carried out as necessary to adjust the shape of the instep cover section 3. The tubular knitting can be partially used, of course, as necessary.

The shoe upper 1 of the first embodiment includes a portion of a double-layer structure in which the instep cover section 3 and the inner side knitted fabric section 4 are overlapped. Normally, when knitting each layer of the knitted fabric of the double-layer structure in parallel with the needle bed on one side, the number of stitches of either one of the layers may become less than the number of stitches of the other layer (state of rough loop quality) as the number of knitting needles becomes less. In the shoe upper 1 of the first embodiment, on the other hand, the loop quality of either layer does not become rough. This is because the inner side knitted fabric section 4 and the instep cover section 3 are sequentially knitted, so that the number of knitting needles does not become small when knitting the sections 3, 4, and the sections 3, 4 can be knitted at the same stitch intervals. Thus, if the loop quality of each section 3, 4 is aligned, satisfactory appearance of the shoe upper 1 is obtained and the strength of the sections 3, 4 can be ensured.

After the knitting of the instep cover section 3 is terminated, a knitting terminating portion of the main body left portion 3L is held on one needle bed, and a knitting terminating portion of the main body right portion 3R is held on the other needle bed. The stitches of the knitting terminating portion of the main body left portion 3L are stitches lined along a contour line K-L on the upper side in the plane of drawing of the sole cover section 2 shown in FIG. 1(B), and the stitches of the knitting terminating portion of the main body right portion 3R are stitches lined along the contour line K-L on the lower side in the plane of drawing of the sole cover section 2. From such state, the flechage knitting is carried out with one needle bed to form the bottom left portion 2L, which is the left side portion of the sole cover section 2, and the flechage knitting is carried out with the other needle bed to form the bottom right portion 2R, which is the right side portion of the sole cover portion 2. Lastly, the bottom left portion 2L and the bottom right portion 2R are connected at the central line K-L to complete the shoe upper 1.

The method of connecting the bottom left portion 2L and the bottom right portion 2R is not particularly limited, and for example, a known bind-off process can be used. Alternatively, the bottom left portion 2L and the bottom right portion 2R may be connected with front and back knits for alternately knitting the stitches with the front and back needle beds. The portions 2L, 2R can be connected in much shorter time by using the front and back knits which do not require transfer, than by using the bind-off process which requires transfer. Since the connecting portion (i.e., knitting terminating portion of shoe upper 1) is fused by the thermal process, to be described later, the connection strength of the connecting portion is ensured regardless of what kind of connecting method is used to form the connecting portion. Furthermore, since the connecting portion is located at a position that cannot be seen when the shoe upper 1 is worn, the appearance of the shoe upper 1 is not impaired by the connecting portion.

According to the procedures described above, the shoe upper 1 can be knitted with barely carrying out, or without carrying out at all, the formation of a widening stitch or a narrowing stitch, the complex transfer and the like. Thus, the shoe upper 1 can be produced with high productivity.

After the knitting of the shoe upper 1 is terminated, the entire shoe upper 1 is fitted into the last and the thermal process is performed to three-dimensionally shape the shoe upper 1. The connecting portion of the bottom left portion 2L and the bottom right portion 2R is fused by the thermal process, and the portions 2L, 2R can be avoided from separating.

<Variation 1-1; Shoe Upper Set Up from Sole Cover Section>

The shoe upper 1 shown in FIG. 1 can be produced by the second producing method of starting the knitting from the side of the sole cover section 2 and terminating the knitting on the side of the instep cover section 3. In this case, the set up portion corresponding to the central line K-L of FIG. 1(B) is knitted across the one needle bed and the other needle bed. Then, the bottom left portion 2L of the sole cover section 2 is knitted with one needle bed, and the bottom right portion 2R of the sole cover section 2 is knitted with the other needle bed to complete the sole cover section 2. After the instep cover section 3 is knitted up to the connecting area (line C-F-E) of the instep cover section 3 and the inner side knitted fabric section 4, the inner side knitted fabric section 4 is branched from the instep cover section 3. The split knitting and the like can be used to form a branched portion. Lastly, the instep cover section 3 is completed, and thereafter, the inner side knitted fabric section 4 is completed, or the inner side knitted fabric section 4 is completed, and thereafter, the instep cover section 3 is completed. In this case, the hem portion of the opening 5 of the instep cover section 3 becomes the knitting terminating portion of the instep cover section 3.

According to another knitting example, the instep cover section 3 may be knitted up to the connecting area (line C-F-E) of the instep cover section 3 and the inner side knitted fabric section 4, and the inner side knitted fabric section 4 may be set up with the empty needles on which the instep cover section 3 is not held. In this case, the set up portion of the inner side knitted fabric section 4 corresponds to the line C-B-A-D-E. After the inner side knitted fabric section 4 is completed from such set up portion, the knitting terminating portion (line C-F-E) of the inner side knitted fabric section 4 is connected to the instep cover section 3, and the remaining portion (portion surrounded with C-H-G-J-E-F) of the instep cover section 3 is knitted.

<Variation 1-2; Shoe Upper Set Up from Instep Cover Section>

In the first embodiment, the inner side knitted fabric section 4 is knitted, and thereafter, the instep cover section 3 is knitted and the inner side knitted fabric section 4 and the instep cover section 3 are connected in the middle of the knitting of the instep cover section 3. On the contrary, a part of the instep cover section 3 may be knitted beforehand, and then the inner side knitted fabric section 4 may be knitted and the inner side knitted fabric section 4 and the instep cover section 3 may be connected. For example, a part (portion surrounded with G-H-C-F) of the main body left portion 3L of the instep cover section 3 may be knitted with one needle bed, and a portion (portion surrounded with G-J-E-F) of the main body right portion 3R may be knitted with the other needle bed. In other words, the knitting of increasing the stitches configuring the instep cover section 3 is carried out without the stitches of the inner side knitted fabric section 4 formed at all. Then, the knitting of the instep cover section 3 is temporary stopped, the inner left portion 4L of the inner side knitted fabric section 4 is knitted using the empty needles of one needle bed, and the inner left portion 4L and the main body left portion 3L are connected using transfer. Similarly, the inner right portion 4R is knitted using the empty needles of the other needle bed, and the inner right portion 4R and the main body right portion 3R are connected using transfer.

According to another knitting example, when the knitting of the instep cover section 3 is temporary stopped, the inner side knitted fabric section 4 may be branched from the instep cover section 3, and then the inner side knitted fabric section 4 may be knitted. In this case, the line C-F-E becomes the set up portion of the inner side knitted fabric section 4, and the line C-B-A-D-E becomes the knitting terminating portion of the inner side knitted fabric section 4.

<Variation 1-3; Shoe Upper Including Outer Side Knitted Fabric Section>

In the first embodiment, the inner side knitted fabric section 4 is formed on the inner side of the instep cover section 3. On the contrary, the outer side knitted fabric section (overlapping knitted fabric section) may be formed on the outer side of the instep cover section 3 in place of the inner side knitted fabric section 4. The shoe upper 1 including the outer side knitted fabric section can be knitted similar to the first embodiment. For example, assuming that the inner side knitted fabric section 4 shown in FIG. 1 is a portion of the instep cover section 3 near the slit 5*s*, and a part of the instep cover section 3 on the outer side of the inner side knitted fabric section 4 shown in FIG. 1 is the outer side knitted fabric section, the knitting of a procedure similar to the first embodiment may be carried out.

Second Embodiment

Figure 2:
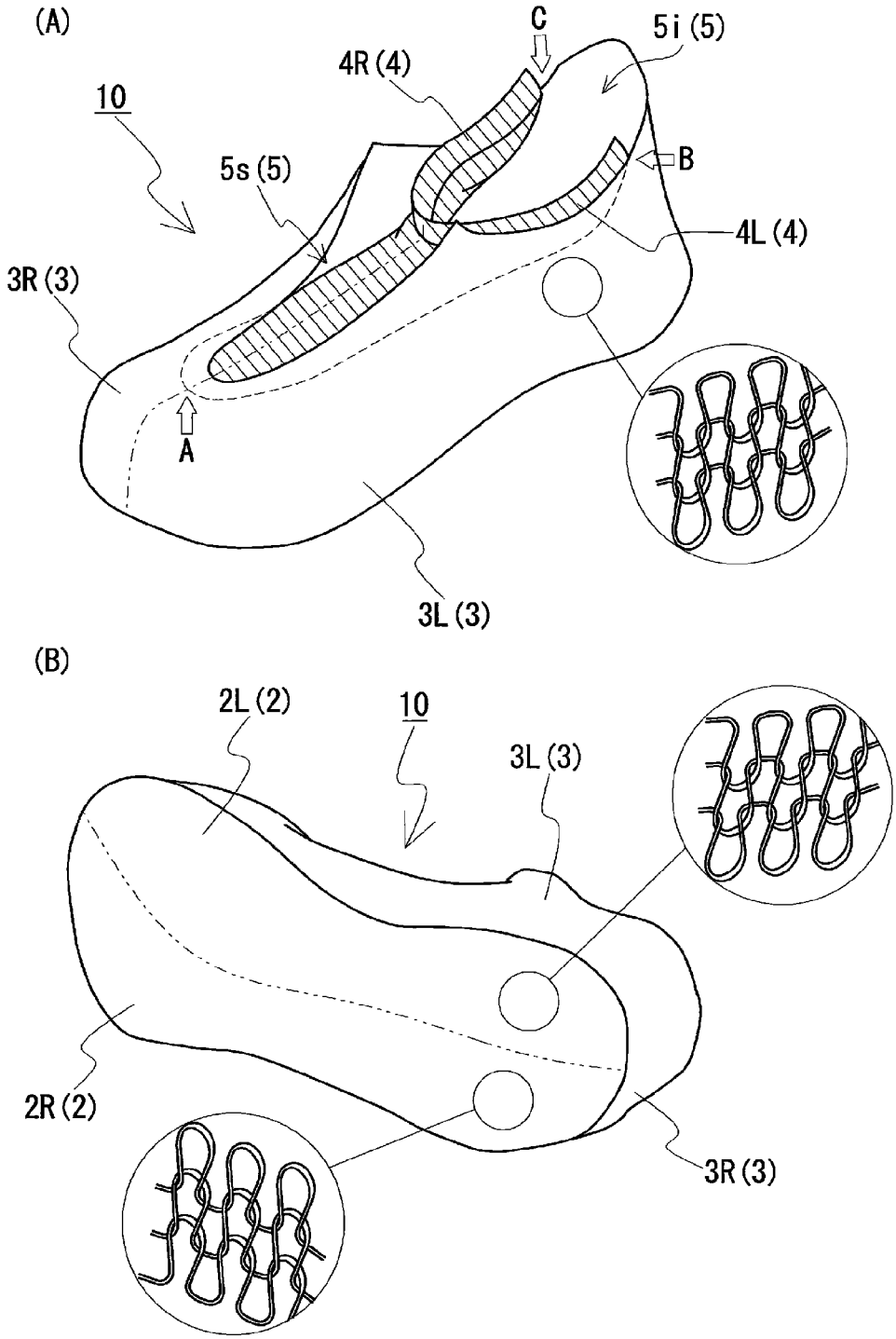
FIG. 2(A) is a schematic top perspective view of a shoe upper shown in a second embodiment.
FIG. 2(B) is a schematic bottom perspective view of the shoe upper.

In the first embodiment, the slit is also formed in the inner side knitted fabric section 4 so as to match the slit 5*s* of the instep cover section 3. On the contrary, the slit of the inner side knitted fabric section 4 may be partially or entirely closed. In the second embodiment, a shoe upper 10 in which the entire slit of the inner side knitted fabric section 4 is closed will be described based on FIG. 2. In FIG. 2, a hatching of about 150° with respect to the horizontal line in the figure is applied to the inner side knitted fabric section 4 for the sake of convenience of explanation.

In the shoe upper 10 of the second embodiment shown in FIG. 2, a part on the toe side of the inner side knitted fabric section 4 is formed to close the entire slit 5*s* of the instep cover section 3, and the remaining part on the heel side of the inner side knitted fabric section 4 is formed to configure a part of the foot insertion opening 5*i*. Of course, the portion on the heel side of the inner side knitted fabric section 4 may be formed over the entire periphery of the foot insertion opening 5*i* of the instep cover section 3.

When knitting the shoe upper 10 of FIG. 2, for example, when knitting the inner left portion 4L of the inner side knitted fabric section 4 with one needle bed and knitting the inner right portion 4R with the other needle bed, the inner left portion 4L and the inner right portion 4R are in a connected state at the portion corresponding to the slit 5*s* of the instep cover section 3. Then, similar to the first embodiment, knitting a part of the main body left portion 3L of the instep cover section 3 and connecting the inner left portion 4L and the main body left portion 3L at the position of line A-B, and knitting a part of the main body right portion 3R and connecting the inner right portion 4R and the main body right portion 3R at the position of line A-C are carried out. In this case, when knitting the main body left portion 3L (main body right portion 3R), the inner left portion 4L (inner right portion 4R) is transferred from the needle bed for knitting the main body left portion 3L (main body right portion 3R). Thereafter, the instep cover section 3 is completed, and furthermore, the sole cover section 2 shown in FIG. 2(B) is completed, similar to the first embodiment.

The shoe upper 10 of the present embodiment can also be set up from the sole cover section 2, and terminated at the instep cover section 3.

Third Embodiment

Figure 3:
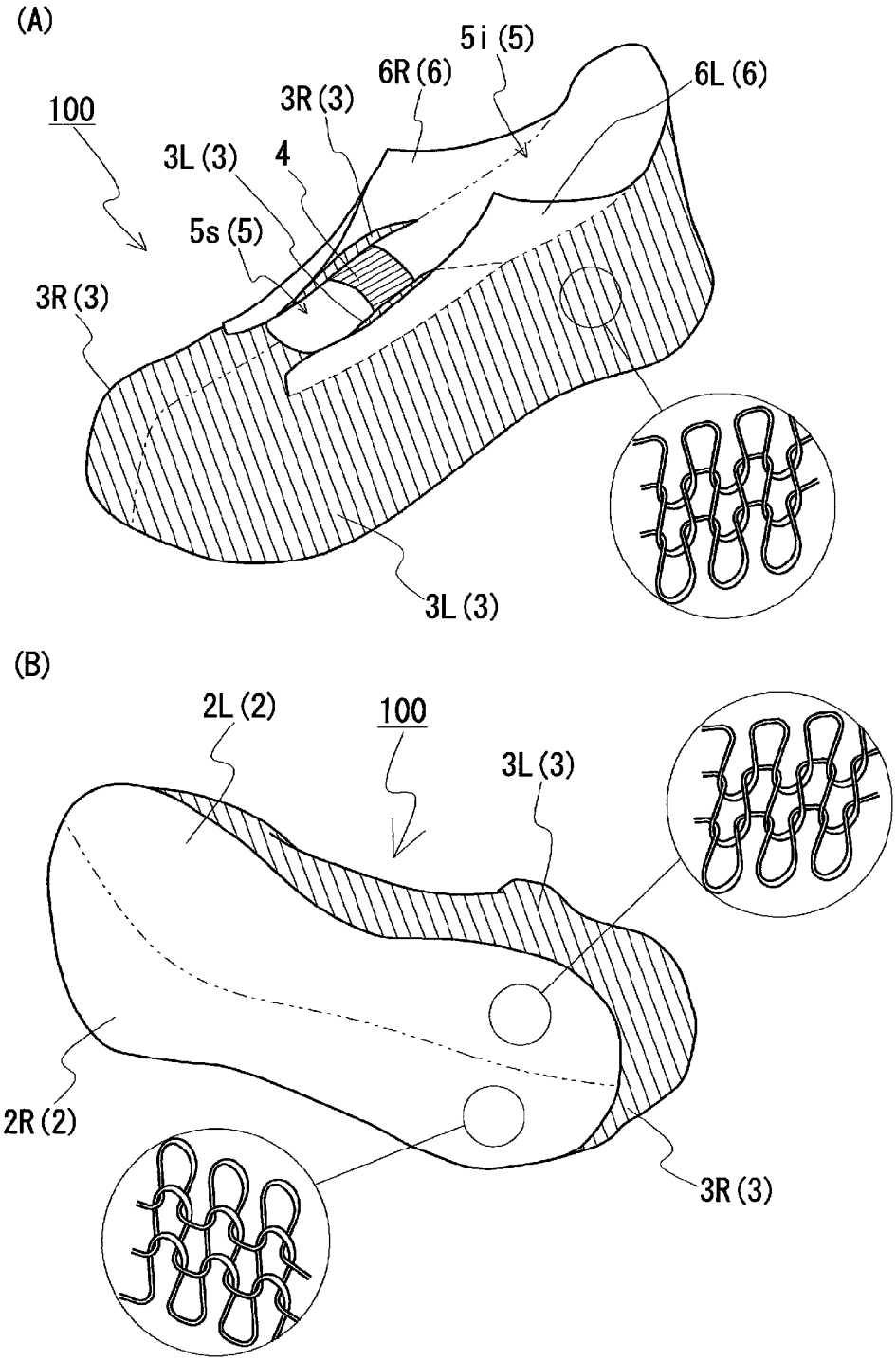
FIG. 3(A) is a schematic top perspective view of a shoe upper shown in a third embodiment.
FIG. 3(B) is a schematic bottom perspective view of the shoe upper.

In a third embodiment, a shoe upper 100 including both the inner side knitted fabric section 4 and the outer side knitted fabric section 6 will be described based on FIG. 3. In FIG. 3, a hatching of about 30° with respect to the horizontal line in the figure is applied to the inner side knitted fabric section 4, and a hatching of about 110° is applied to the portion on the front side of the instep cover section 3 for the sake of convenience of explanation.

When knitting the shoe upper 100 of FIG. 3, for example, the inner side knitted fabric section 4 may be knitted first. After forming a set up portion crossing over the one needle bed and the other needle bed, the inner side knitted fabric section 4 may be knitted with both needle beds or with either one of the needle beds. If the inner side knitted fabric section 4 is knitted with an elastic knitting yarn, the spacing of the slit 5*s* of the instep cover section 3 can be suppressed from opening in excess and the shoe upper 1 can be fitted to the foot of the wearer by the contraction of the inner side knitted fabric section 4. Furthermore, the thickness of the inner side knitted fabric section 4 can be increased and the shrinkage property of the inner side knitted fabric section 4 can be enhanced by tubular knitting the inner side knitted fabric section 4.

According to the procedure similar to the first embodiment, knitting a part of the main body left portion 3L of the instep cover section 3 and connecting the main body left portion 3L and the inner side knitted fabric section 4, and knitting a part of the main body right portion 3R and connecting the main body right portion 3R and the inner side knitted fabric section 4 are carried out.

Then, a part of the instep cover section 3 and the outer side knitted fabric section 6 are knitted, and the instep cover section 3 and the outer side knitted fabric section 6 are connected. Such knitting and connecting can be carried out similar to the knitting and connecting of the inner side knitted fabric section 4 and the instep cover section 3. Specifically, the main body left portion 3L is knitted to the connecting position to be connected with the outer left portion 6L, which is the left side portion of the outer side knitted fabric section 6. The stitches of the main body left portion 3L are temporarily moved from one needle bed to the other needle bed, and then the outer left portion 6L is knitted, and the main body left portion 3L and the outer left portion 6L are connected. The main body right portion 3R is knitted to the connecting position to be connected with the outer right portion 6R, which is the right side portion of the outer side knitted fabric section 6. The stitches of the main body right portion 3R are temporarily moved from the other needle bed to the one needle bed, and then the outer right portion 6R is knitted and the main body right portion 3R and the outer right portion 6R are connected.

Subsequently, the instep cover section 3 is completed and the sole cover section 2 shown in FIG. 3(B) is further completed, similar to the first embodiment, to produce the shoe upper 100 of FIG. 3.

In the shoe upper 100 of the third embodiment, there is a portion of a three-layer structure in which the instep cover section 3, the inner side knitted fabric section 4, and the outer side knitted fabric section 6 are overlapped. As already described in the first embodiment, normally, when knitting each layer of the knitted fabric of the multi-layer structure in parallel with the needle bed on one side, the loop quality of either one of the layers becomes rough as the number of knitting needles becomes short. In the shoe upper 100 of the third embodiment, on the other hand, the loop quality of either one of the layers does not become rough. This is because the inner side knitted fabric section 4, the instep cover section 3, and the outer side knitted fabric section 6 are sequentially knitted.

The shoe upper 100 can also be set up from the sole cover section 2, and terminated with the instep cover section 3.

DESCRIPTION OF SYMBOLS

1, 10, 100 shoe upper
2 sole cover section
2L bottom left portion
2R bottom right portion
3 instep cover section
3L main body left portion
3R main body right portion
4 inner side knitted fabric section (overlapping knitted fabric section)
4L inner left portion
4R inner right portion
5 opening
5*i* foot insertion opening
5*s* slit
6 outer side knitted fabric section (overlapping knitted fabric section)
6L outer left portion
6R outer right portion

The invention claimed is:

1. A method for producing a shoe upper including an instep cover section that includes an opening and covers a portion on an instep side of a wearer and a sole cover section that covers a sole of the wearer;

wherein the instep cover section and the sole cover section are integrally knitted in a seamless manner with a flat knitting machine including at least a pair of a front and a back needle bed, either by carrying out process α that includes knitting a set up portion of the instep cover section and then carrying out process β and connecting the sole cover section knitted in a state separated to right and left in the process β, or by carrying out the process β that includes knitting the set up portion of the sole cover section and then carrying out the process α and carrying out unraveling prevention of a knitting terminating portion of the instep cover section;

[process α] knitting a main body left portion with one needle bed of the flat knitting machine and knitting a main body right portion with the other needle bed of the flat knitting machine using at least one of flechage knitting or tubular knitting so that the main body left portion to become a left side portion of the instep cover section and the main body right portion to become a right side portion of the instep cover section are connected on a heel side and a toe side of the shoe upper; and

[process β] knitting a bottom left portion with one needle bed of the flat knitting machine and knitting a bottom right portion with the other needle bed of the flat knitting machine using flechage knitting so that the bottom left portion to become a left side portion of the sole cover section and the bottom right portion to become a right side portion of the sole cover section are separated.

2. The method for producing the shoe upper according to claim 1, wherein when knitting an overlapping knitted fabric section in which the set up portion or the knitting terminating portion is connected to the main body left portion and the main body right portion and overlapped in a thickness direction of the instep cover section, knitting of increasing a stitch row configuring the instep cover section is not carried out until the knitting of the overlapping knitted fabric section is terminated; and when increasing the stitch row configuring the instep cover section, a state in which stitches of the overlapping knitted fabric section are not held on the needle beds for knitting the instep cover section is obtained.

3. The method for producing the shoe upper according to claim 2, wherein in the process α, the overlapping knitted fabric section is set up at a position overlapping a knitting region of the instep cover section, and the overlapping knitted fabric section is completed using the flechage knitting, and thereafter, a stitch row of the knitting terminating portion of the overlapping knitted fabric section is overlapped and connected with a stitch row of a part of the instep cover section and knitting is carried out to increase the stitch row configuring the instep cover section.

4. The method for producing the shoe upper according to claim 2, wherein in the process α, the set up portion of the overlapping knitted fabric section branched from the instep cover section is knitted at the position overlapping the knitting region of the instep cover section; and the overlapping knitted fabric section is completed following the set up portion, and the overlapping knitted fabric section is removed from the needle beds.

5. The method for producing the shoe upper according to claim 2, wherein the overlapping knitted fabric section is connected to a vicinity of the opening of the instep cover section.

6. The method for producing the shoe upper according to claim 1, wherein when carrying out the process β after the process α, the sole cover section in the process β is knitted with a fusible knitting yarn including a heat fusible yarn; and after connecting the bottom left portion and the bottom right portion knitted in a state separated in the process β by knitting, a connecting portion is fused by thermal process.

7. A shoe upper including an instep cover section that includes an opening and covers a portion on an instep side of a wearer and a sole cover section that covers a sole of the wearer; wherein with a left side portion and a right side portion of the instep cover section being a main body left portion and a main body right portion, respectively, and a left side portion and a right side portion of the sole cover section being a bottom left portion and a bottom right portion, respectively;

a seam is not formed between the main body left portion and the bottom left portion and between the main body right portion and the bottom right portion, and a set up portion or a knitting terminating portion of the shoe upper is formed at a boundary portion of the bottom left portion and the bottom right portion; and a knitting width direction of the instep cover section and the sole cover section is a length direction of the shoe upper.

* * * * *